US009140048B2

(12) United States Patent
Langford

(10) Patent No.: US 9,140,048 B2
(45) Date of Patent: Sep. 22, 2015

(54) ACTUATOR WITH LOCKING ARRANGEMENT

(75) Inventor: David John Langford, Coven (GB)

(73) Assignee: GOODRICH ACTUATION SYSTEMS LIMITED (GB)

( * ) Notice: Subject to any disclaimer, the term of this patent is extended or adjusted under 35 U.S.C. 154(b) by 593 days.

(21) Appl. No.: 13/484,555

(22) Filed: May 31, 2012

(65) Prior Publication Data

US 2012/0312154 A1 Dec. 13, 2012

(30) Foreign Application Priority Data

Jun. 7, 2011 (GB) ..... 1109487.7

(51) Int. Cl.
*F15B 15/26* (2006.01)
*E05F 15/611* (2015.01)
*E05F 15/53* (2015.01)

(52) U.S. Cl.
CPC ..... *E05F 15/611* (2015.01); *E05F 15/53* (2015.01); *Y10T 403/7009* (2015.01)

(58) Field of Classification Search
CPC ..... F15B 15/261; F15B 15/26; F15B 13/01; F16D 2127/02
USPC ..... 92/17, 23
See application file for complete search history.

(56) References Cited

U.S. PATENT DOCUMENTS

2010/0024580 A1 * 2/2010 Hadley et al. ..... 74/89.26

* cited by examiner

*Primary Examiner* — Edward Look
*Assistant Examiner* — Jason Mikus
(74) *Attorney, Agent, or Firm* — Cantor Colburn LLP

(57) ABSTRACT

An actuator comprises an actuator output shaft, a rotatable lock formation associated with the output shaft so as to be axially fixed relative thereto, the lock formation defining an entry passage, a lock pocket and an exit passage, a pin positioned for movement relative to the lock formation such that, as the actuator approaches a fully extended position, a part of the pin is received within and passes along the entry passage, and resilient detent means operable such that, once the pin has moved beyond a predetermined position within the entry passage, the resilient detent means prevents return movement of the pin along the entry passage.

12 Claims, 2 Drawing Sheets

ACTUATOR WITH LOCKING ARRANGEMENT

This invention relates to an actuator, for example a hydraulically or pneumatically operated actuator, incorporating a locking arrangement whereby the actuator can be locked in its extended position against movement back towards its retracted position. Although the description herein relates primarily to hydraulic or pneumatic actuators, it will be understood that the invention is not restricted in this regard and could also be applied to, for example, electric motor driven actuators.

The engine cowl doors of an aircraft gas turbine engine are typically arranged to be driven between closed, in use positions and open positions permitting access to parts of the engine for maintenance and service purposes. Commonly, the doors are driven between these positions by an actuator in the form of a simple hydraulic piston or ram. Each individual door is of significant weight, and there is a need to provide means whereby the doors can be supported when open as movement of the doors whilst maintenance and servicing operations are being undertaken could result in injury to maintenance personnel or could cause damage to the engine. Whilst a simple hydraulic actuator is sufficient to drive a door between its closed and open positions, using the actuator to hold the door against movement in its open position would require the hydraulic pump associated therewith to continue to operate throughout the time that the door is to be held open or pressure be otherwise maintained in the actuator. Should the pump be stopped, the associated door or doors may start to move towards the closed position. Similarly, the occurrence of a leak or other failure resulting in a loss of pressure could cause uncontrolled movement of the door.

It is known to provide actuators for use in this application with a push-push locking mechanism whereby, once the actuator has reached its fully extended position, retraction of the actuator by a small distance results in the actuator occupying a locked, extended position. To disengage the locking mechanism and return the actuator to its fully retracted position requires the actuator to first be returned to its fully extended position. Whilst such an arrangement permits locking of the actuator in an extended position, and so does not require the associated hydraulic pump to be operating throughout the period of time that the associated door or doors are to be held in their open positions, there is a risk that if the actuator has not fully extended before being retracted by a small amount, the actuator may come to rest in an intermediate position and appear to be locked in its extended position without the locking mechanism being properly engaged. In such circumstances, after the hydraulic pressure has been removed, jarring or vibrations could result in disengagement of the lock arrangement and the actuator being unable to hold the door(s) in the open position, Clearly, this is undesirable.

According to the present invention there is provided an actuator comprising an actuator output shaft, a rotatable lock formation associated with the output shaft so as to be axially fixed relative thereto, the lock formation defining an entry passage, a lock pocket and an exit passage, a pin positioned for movement relative to the lock formation such that, as the actuator approaches a fully extended position, a part of the pin is received within and passes along the entry passage, and resilient detent means operable such that, once the pin has moved beyond a predetermined position within the entry passage, the resilient detent means prevents return movement of the pin along the entry passage.

The resilient detent means conveniently comprises a resilient finger which deflects as the pin passes over the finger, movement of the pin past the finger permitting the finger to return to a rest position in which it prevents return movement of the pin along the entry passage. The finger conveniently includes a sloped end surface cooperable with the pin to cause rotation of the lock formation to direct return movement of the pin towards the lock pocket.

It will be appreciated that such an arrangement is advantageous in that the lock formation will only hold the actuator in a locked position if the actuator has been fully extended, moving the pin sufficiently far along the entry passage to activate the detent means. If such a position is not reached, the actuator will not be locked and the door will close immediately when the hydraulic pressure is removed from the actuator.

The lock formation conveniently includes a ramped release surface positioned such that movement of the actuator from its locked position to its fully extended position brings the pin and ramped release surface into engagement with one another, causing rotation of the lock formation to a position in which upon subsequent retraction of the actuator the pin enters and passes through the exit passage.

The lock formation conveniently comprises a sleeve encircling part of the output shaft, the sleeve being rotatable relative to the shaft but axially fixed relative to the shaft. Alternatively, arrangements may be possible in which the lock formation is rigidly secured to, or integral with, the output shaft, the output shaft being rotatable in such arrangements.

The actuator conveniently includes at least two pins.

Each exit passage is conveniently designed in such a manner that it can also serve as an entry passage, depending upon the angular position of the lock formation as the actuator is moved from its retracted position and approaches its fully extended position.

The fingers are conveniently provided upon a collar, each finger extending along a respective one of the entry passages. The free end part of each finger is conveniently of increased radial thickness, the end part being deflected by the cooperation thereof with the pin as the pin passes over the end part.

The actuator is conveniently an hydraulically driven actuator, the output shaft being connected to a piston slidable within a cylinder of the actuator. However, other arrangements are possible. For instance the actuator could comprise a motor driven, for example electric motor driven, actuator.

The invention will further be described, by way of example, with reference to the accompanying drawings, in which.

Figure 1:
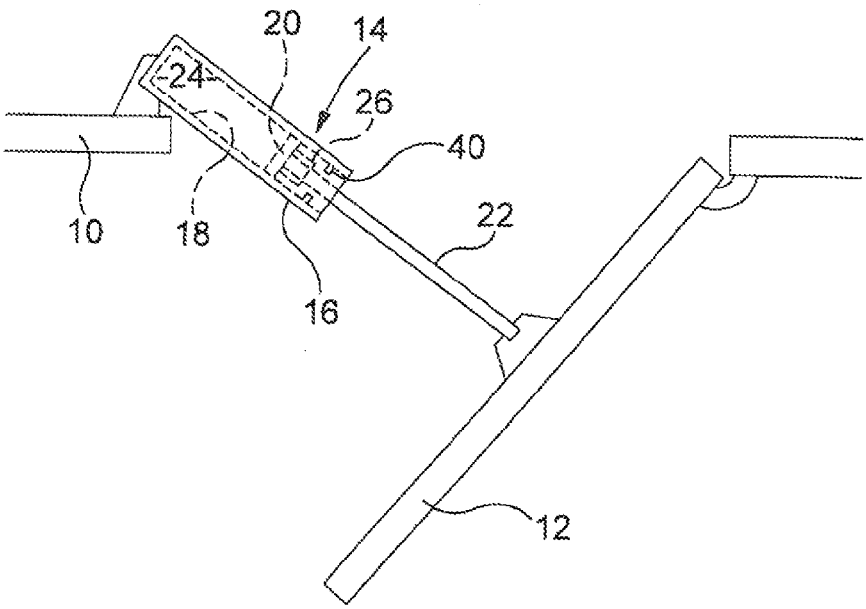
FIG. 1 is a diagram illustrating an actuator according to an embodiment of the invention, in use.

Referring firstly to FIG. 1 there is illustrated, diagrammatically, a part of an engine housing 10 including a door 12 movable between a closed, in use position and an open position. The door 12 is shown in its open position in FIG. 1. The door 12 is arranged to be driven between these positions by an actuator 14 in the form of a hydraulic piston or ram. The actuator 14 comprises a housing 16 defining a cylinder 18 within which a piston 20 is slidable, an output shaft 22 being connected to the piston 20. The housing 16 is mounted to the engine housing 10 whilst the door 12 is connected to an end of the output shaft 22. By appropriate control over the pressure of fluid applied to a chamber 24 of the actuator 14 it will be appreciated that extension and retraction of the actuator 14 can be controlled, and consequently that the associated door 12 can be driven in a controlled manner between its closed and open positions, when desired.

Figure 2:
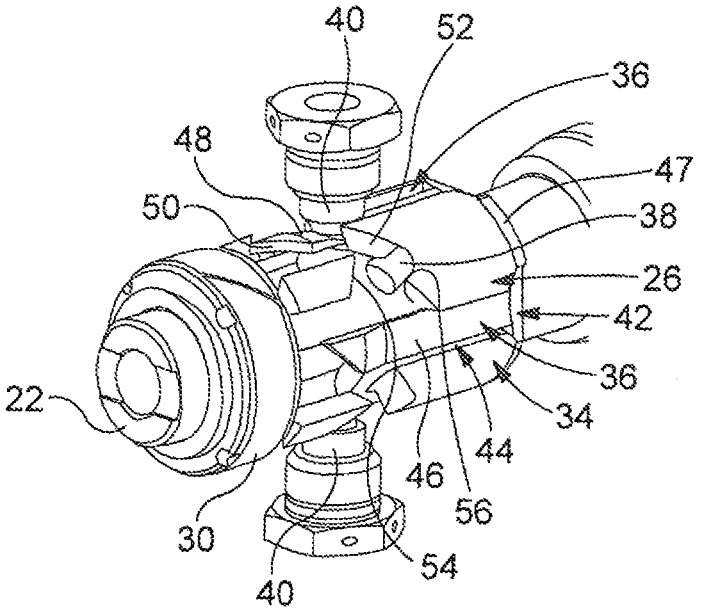
FIG. 2 is a diagram illustrating part of the actuator shown in FIG. 1.
Figure 3:
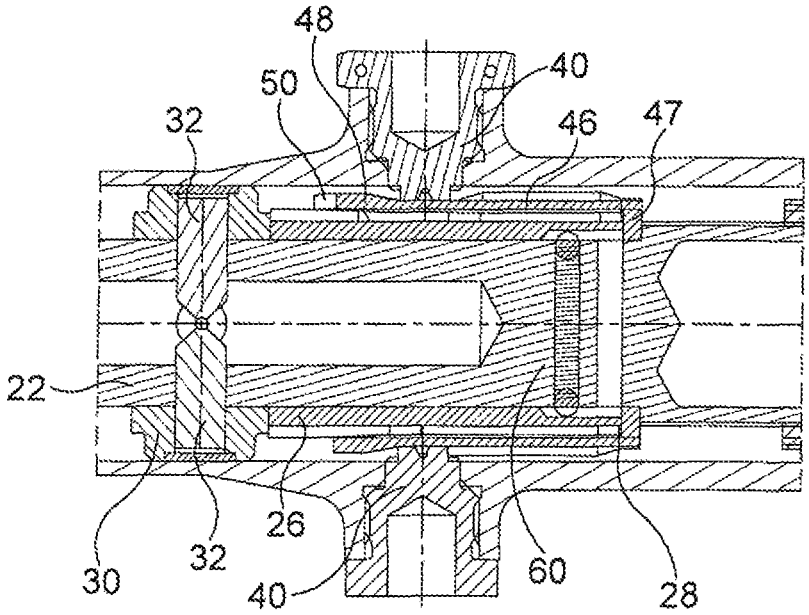
FIG. 3 is a sectional view illustrating the part of the actuator shown in FIG. 2.

As best shown in FIGS. 2 and 3, a sleeve 26 encircles part of the output shaft 22. The sleeve 26 is secured to the output shaft 22 in such a manner that axial movement of the sleeve 26 relative to the shaft 22 is prevented or restricted, whilst the sleeve 26 is capable of rotation relative to the output shaft 22. Whilst such mounting of the sleeve 26 to the shaft 22 may be achieved in a number of ways, in the arrangement illustrated the sleeve 26 is held captive to the shaft 22 by virtue of a step 28 provided on the shaft 22 restricting or preventing movement of the sleeve 26 in one axial direction, and a collar 30 secured to the shaft 22 by pins 32 which extend through openings formed in the shaft 22 which prevents or restricts movement of the sleeve 26 in the opposite axial direction.

The sleeve 26 is shaped to define a lock formation 34 including entry and exit passages 36 and lock pockets 38. The actuator housing 16 carries a pair of radially extending pins 40, the pins 40 being arranged and positioned such that as the actuator approaches its fully extended position, the sleeve 26 approaches and is positioned adjacent the pins 40, and the inner ends of the pins 40 enter respective ones of the passages 36. As shown, the passages 36 are formed with enlarged mouths 42 to assist in entry of the end parts of the pins 40 into the passages 36, and so reduce the risk of the pins 40 butting against the end of the sleeve 26.

The actuator further comprises resilient detent means 44 in the form of a series of resilient fingers 46 extending within and along respective ones of the passages 36. The fingers 46 are interconnected by a collar 47 which is engaged between the sleeve 26 and the step 28, thereby securing the fingers 46 in position. Each finger 46 is shaped, at its free end, to be of increased radial dimension, a ramp 48 being provided on the outer surface thereof. In use, as the actuator approaches its fully extended position, the pins 40 bear against the ramps 48, causing the end parts of the fingers 46 to deflect radially inwards until the fully extended actuator position is reached. Once this position is reached, the resilience of the fingers will result in the fingers returning to their non-deflected position, preventing return movement of the pins 40 along the passages 36. As shown, each finger 46 includes a sloped end surface 50, the slope being orientated such that the cooperation between the pins 40 and sloped surfaces 50 that occurs upon retracting movement of the actuator causes rotation of the sleeve 26 relative to the pins 40 and the housing 16. Continued retracting movement brings the pins 40 into engagement with sloped surfaces 52 of the sleeve 26, causing further rotation of the sleeve 26, and ultimately results in the pins 40 being accommodated within respective lock pockets 38. Once received within the lock pockets 38, it will be appreciated that the pins 40 prevent further retracting movement of the actuator, thus the actuator is locked in an extended position just short of its fully extended position, holding the door 12 in its open position.

It will be appreciated that if, during extension of the actuator, the actuator does not reach its fully extended position, the pins 40 will not move past the ends of the fingers 46. Consequently, upon subsequent retraction the pins 40 will not engage the surfaces 52 or pockets 38, and the actuator will not be locked in its extended position. Such a condition will be clearly apparent as retraction of the actuator will not be prevented, the door 12 moving towards its closed position immediately upon removal of the hydraulic supply to the actuator, and so the risk of the actuator appearing, falsely, to be locked when, in fact, it is not locked is reduced.

From the locked position, in order to retract the actuator and close the door 12, the actuator 14 must first be returned to its fully extended position. Such movement brings the pins 40 into contact with ramped release surfaces 54, driving the sleeve 26 for rotation with the result that, upon subsequent retraction of the actuator, the pins 40 move into engagement with ramped surfaces 56 causing further rotation of the sleeve 26 until the pins 40 are able to enter the adjacent passages 36. It will be appreciated that, during such movement, the pins 40 ride onto parts of the fingers 46 spaced from the increased diameter end parts thereof, and so no deflection of the fingers 46 is required during such movement.

As with a traditional push-push type arrangement, each passage 36 is able to serve as both an entry passage along which the pins 40 pass during extending movement and as an exit passage along which the pins 40 move during retraction. During each operating cycle of the actuator, the passage which are, initially, angularly aligned with the pins 40 as the actuator extends serve as entry passages, and the adjacent passages serve, subsequently, as exit passages. During the next operating cycle, the passages which had last served as the exit passages will be aligned with the pins and so will serve as entry passages, no rotation of the sleeve 26 having occurred. As shown in FIG. 3, a spring biased retainer 60 may be provided to interact with formations provided internally of the sleeve 26 to resist undesired angular movement.

It will be appreciated that the actuator of the present invention is of simple and convenient form. It is envisaged that existing actuators may be modified to incorporate the invention by removal of certain ramped surfaces thereof and by the addition of the detent means. The modifications necessary to incorporate the invention are sufficiently small that it is thought that the invention may be retrofitted to existing actuators in a convenient manner.

Whilst one form of the invention has been described herein, it will be appreciated that a wide range of modifications and alterations may be made without departing from the scope of the invention. For example, the detent means could be modified to include pins which are resiliently biased and arranged to ride over fixed ramps, rather than providing fixed pins which cause deflection of ramped fingers, to provide the detent means. Whilst the description hereinbefore relates primarily to an hydraulically operated actuator, it will be appreciated that the invention is not restricted in this regard and could be applied to, for example, electric motor driven actuators or the like. Other arrangements are also possible.

The invention claimed is:

1. An actuator comprising an actuator output shaft, a rotatable lock formation associated with the output shaft so as to be axially fixed relative thereto, the lock formation defining an entry passage, a lock pocket and an exit passage, a pin positioned for rotating and translating movement relative to the lock formation such that, as the actuator approaches a fully extended position, a part of the pin is received within and passes along the entry passage, and resilient detent means operable such that, once the pin has moved beyond a predetermined position within the entry passage, the resilient detent means prevents return movement of the pin along the entry passage.

2. An actuator according to claim 1, wherein the resilient detent means comprises a resilient finger which deflects as the pin passes over the finger, movement of the pin past the finger permitting the finger to return to a rest position in which it prevents return movement of the pin along the entry passage.

3. An actuator according to claim 1, wherein the finger includes a sloped end surface co operable with the pin to cause rotation of the lock formation to direct return movement of the pin towards the lock pocket.

4. An actuator comprising an actuator output shaft, a rotatable lock formation associated with the output shaft so as to be axially fixed relative thereto, the lock formation defining an entry passage, a lock pocket and an exit passage, a pin positioned for movement relative to the lock formation such that, as the actuator approaches a fully extended position, a part of the pin is received within and passes along the entry passage, and resilient detent means operable such that, once the pin has moved beyond a predetermined position within the entry passage, the resilient detent means prevents return movement of the pin along the entry passage, wherein the lock formation includes a ramped release surface positioned such that movement of the actuator from its locked position to its fully extended position brings the pin and ramped release surface into engagement with one another, causing rotation of the lock formation to a position in which upon subsequent retraction of the actuator the pin enters and passes through the exit passage.

5. An actuator according to claim 1, wherein the lock formation comprises a sleeve encircling part of the output shaft, the sleeve being rotatable relative to the shaft but axially fixed relative to the shaft.

6. An actuator according to claim 1, wherein the lock formation is rigidly secured to, or integral with, the output shaft, the output shaft being rotatable.

7. An actuator according to claim 1, wherein the actuator includes at least two pins.

8. An actuator according to claim 1, wherein each exit passage is designed in such a manner that it can also serve as an entry passage, depending upon the angular position of the lock formation as the actuator is moved from its retracted position and approaches its fully extended position.

9. An actuator according to claim 1, wherein the fingers are provided upon a collar, each finger extending along a respective one of the entry passages.

10. An actuator according to claim 1, wherein the free end part of each finger is of increased radial thickness, the end part being deflected by the cooperation thereof with the pin as the pin passes over the end part.

11. An actuator according to claim 1, further comprising an actuator housing upon which the pin is mounted.

12. An actuator according to claim 1, wherein the actuator is an hydraulically driven actuator, the output shaft being connected to a piston slidable within a cylinder of the actuator.

* * * * *